US006902056B2

(12) United States Patent
Dotterman et al.

(10) Patent No.: US 6,902,056 B2
(45) Date of Patent: Jun. 7, 2005

(54) BRUSH CADDY

(75) Inventors: Perry S. Dotterman, Maplewood, MN (US); Michael J. Kubes, Oakdale, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 298 days.

(21) Appl. No.: 10/207,590

(22) Filed: Jul. 29, 2002

(65) Prior Publication Data

US 2004/0016664 A1 Jan. 29, 2004

(51) Int. Cl.[7] ..... B65D 83/10
(52) U.S. Cl. ..... 206/361; 206/362.3
(58) Field of Search ..... 206/361, 362.2, 206/362.3, 15.3, 233; 15/106, 104.94; D4/138; D6/551, 524; 211/65

(56) References Cited

U.S. PATENT DOCUMENTS

| | | | | | |
|---|---|---|---|---|---|
| 3,085,678 | A | * | 4/1963 | Charles | 206/361 |
| 4,211,750 | A | * | 7/1980 | Gillespie | 422/123 |
| D276,291 | S | | 11/1984 | Boroch | |
| D291,039 | S | | 7/1987 | Bokmiller | |
| 4,700,423 | A | | 10/1987 | Zuliani | |
| D297,292 | S | * | 8/1988 | Plymale | D6/551 |
| 4,776,456 | A | | 10/1988 | Lewis | |
| D298,712 | S | | 11/1988 | Mattei | |
| D315,269 | S | | 3/1991 | Brazis | |
| D329,775 | S | * | 9/1992 | Murphy | D6/551 |
| D345,271 | S | * | 3/1994 | Vetter | D6/551 |
| D360,986 | S | * | 8/1995 | Hoagland | D4/138 |
| D400,748 | S | | 11/1998 | France | |
| 5,941,379 | A | | 8/1999 | Barardo | |
| 6,726,010 | B2 | * | 4/2004 | Kaminstein | 206/361 |

FOREIGN PATENT DOCUMENTS

| | | |
|---|---|---|
| FR | 1.350.418 | 1/1964 |
| WO | WO 01/60200 A1 | 8/2001 |
| WO | WO 01/60200 | 8/2001 |

OTHER PUBLICATIONS

Pages HC–2 and HC–16 of a catalog from Hayco Manufacturing Ltd., showing brushes and brush holders sold more than one year prior to the filing date of the subject application.

* cited by examiner

*Primary Examiner*—Jacob K. Ackun
*Assistant Examiner*—J Williams
(74) *Attorney, Agent, or Firm*—William L. Huebsch

(57) ABSTRACT

A caddy having a socket shaped to receive the scrubbing end portion of a cleaning implement such as a brush when the implement is being stored, particularly including the type of cleaning implement having a long handle that is used for cleaning toilet bowls or the like that is commonly used and stored in bathrooms. The cooperating shapes of the cleaning and a socket in the caddy allow storage of the cleaning implement or brush either with the long handle of the cleaning implement projecting upwardly in the conventional manner, or with its long handle extending generally horizontally, thereby facilitating storage of the caddy containing the cleaning implement in cabinets of the types typically found in bathrooms.

20 Claims, 8 Drawing Sheets

BRUSH CADDY

FIELD OF THE INVENTION

The present invention relates to caddies having sockets for receiving the scrubbing end portions of cleaning implements (e.g., brushes) when the cleaning implement is being stored, particularly including such caddies for storing the types of cleaning implements with long handles used for cleaning toilet bowls or the like that are commonly used and stored in bathrooms.

BACKGROUND

The art is replete with caddies having sockets for receiving the scrubbing end portions of cleaning implements (e.g., brushes) when the cleaning implements are being stored, particularly including such caddies for storing the types of cleaning implements with long handles used for cleaning toilet bowls or the like that are commonly used and stored in bathrooms. U.S. Design Pat. Nos. 345,271; 297,292; 329,775; 276,291; 298,712; 315,269; 400,748; and 291,039; U.S. Pat. No. 4,776,456; and International Publication No. WO 01/60200 A1 provide illustrative examples. Typically, such caddies store the cleaning implement with the handle of the cleaning implement projecting generally vertically upwardly which is convenient for retrieving the cleaning implement when it is to be used, but which, because of the length of the handle and overall length of the cleaning implement (e.g., 16+ inches or 40+ centimeters), makes the caddy and cleaning implement combination inconvenient to store in storage cabinets of the type typically found in bathrooms.

DISCLOSURE OF THE INVENTION

The present invention provides a caddy having a socket for receiving an end portion of a cleaning implement (e.g., a brush) when the cleaning implement is being stored, particularly including the type of cleaning implement or brush having a long handle portion that is used for cleaning toilet bowls or the like and is commonly used and stored in bathrooms. The caddy allows storage of the cleaning implement with the long handle portion of the cleaning implement projecting upwardly in the conventional manner, and also allows the storage of the cleaning implement with its long handle portion extending generally horizontally, thereby facilitating storage of the caddy containing the cleaning implement in cabinets of the types typically found in bathrooms (e.g., a vanity) which may be desirable or necessary, for example, for aesthetic reasons or to keep the cleaning implement away from children.

According to the present invention there is provided a caddy for storing a cleaning implement, which cleaning implement comprises an elongate support member including a generally straight support end portion and a handle end portion. Ends of the support and handle end portions are fixed together with the support end portion and the handle end portion disposed at an obtuse angle with respect to each other (e.g., about 153 degrees). A part of the handle end portion adjacent its end opposite the support end portion is adapted for manual engagement. The cleaning implement includes scrubbing members (e.g., bristles or randomly disposed mineral coated fibers) having inner end parts supported on (e.g., imbedded in) the support end portion. Outer portions of some of the scrubbing members define a convex arcuate end peripheral surface portion (e.g., a convex generally semi-spherical end peripheral surface) extending about 180 degrees around the end of the support end portion opposite the handle end portion. Outer portions of other scrubbing members further define a convex arcuate side peripheral surface (e.g., a convex semi cylindrical side peripheral surface) extending from that convex end peripheral surface toward the handle portion along the side of the support end portion. The caddy comprises walls having a supported surface adapted to be supported on a horizontal surface, and has receiving surfaces defining a socket adapted to receive and support the scrubbing members on the support end portion of the support member. Those receiving surfaces include a concave arcuate side surface (e.g., a concave semi-cylindrical side surface) adapted to support the convex side peripheral surface portion defined by the scrubbing members, which concave arcuate side surface has an axis disposed at an acute angle (e.g., about 55 degrees) with respect to the supported surface, and extends from an inlet end of the socket toward the supported surface. The receiving surfaces further include a concave arcuate end surface (e.g., a generally semi-spherical end surface) at the innermost end of the socket adapted to support the convex arcuate end peripheral surface portion defined by the scrubbing members. The cleaning implement can either be (1) positioned in the socket in a vertical storage position with the portions of the scrubbing members defining the convex end peripheral surface portion resting against the concave arcuate end receiving surface, with the portions of the scrubbing members defining the convex arcuate side peripheral surface portion resting against the concave arcuate side surface, and with the handle portion outside of the socket and projecting generally normally away from the supported surface of the caddy (i.e., projecting generally vertically upwardly if the supported surface is supported on a horizontal surface); or (2) positioned in the socket in a horizontal storage position with the convex end peripheral surface portion defined by the scrubbing members resting against the concave arcuate end surface, with the support portion resting against the caddy at the inlet end of the socket, and with the handle portion outside of the socket and projecting away from the caddy generally parallel to the supported surface.

BRIEF DESCRIPTION OF THE DRAWING

The present invention will be further described with reference to the accompanying drawing wherein like reference numerals refer to like parts in the several views, and wherein.

DETAILED DESCRIPTION

Figure 1:
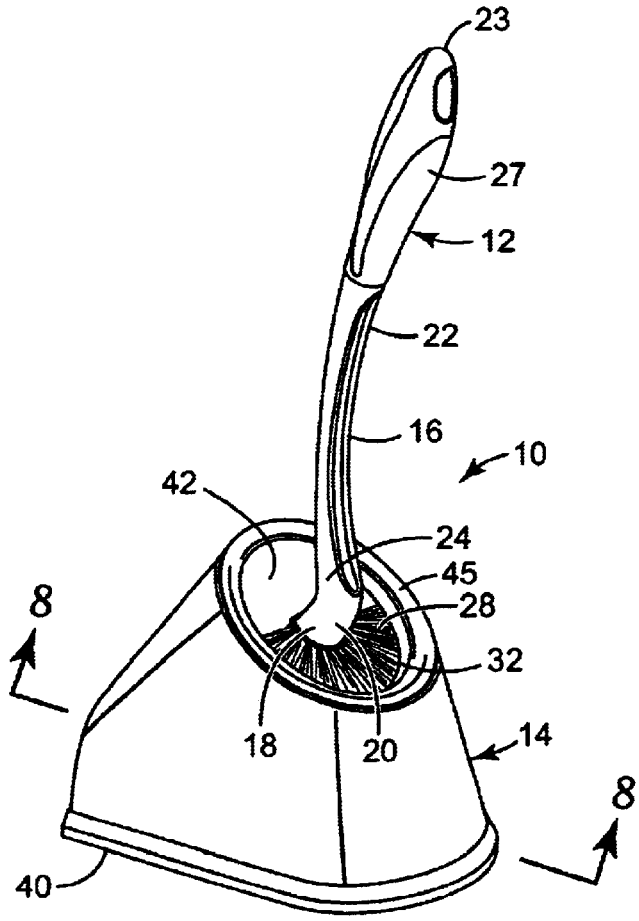
FIG. 1 is a perspective view of a combination of a cleaning implement or brush and a caddy according to the present invention in which the brush is positioned in the caddy in a vertical storage position with a handle portion of the brush outside of the caddy and projecting generally vertically upwardly away from the caddy.
Figure 2:
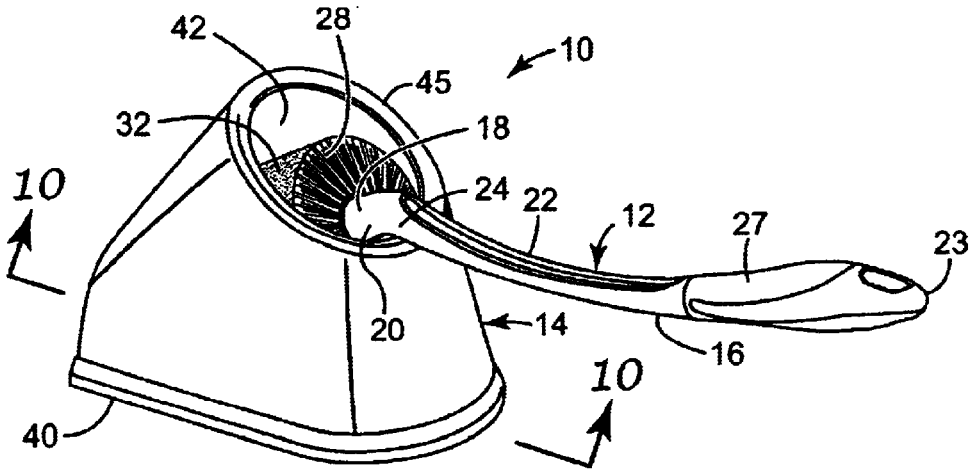
FIG. 2 is a perspective view of the combination of FIG. 1 in which the brush is positioned in the caddy in a horizontal storage position with a handle portion of the brush outside of the caddy and projecting generally horizontally away from the caddy.
Figure 3:
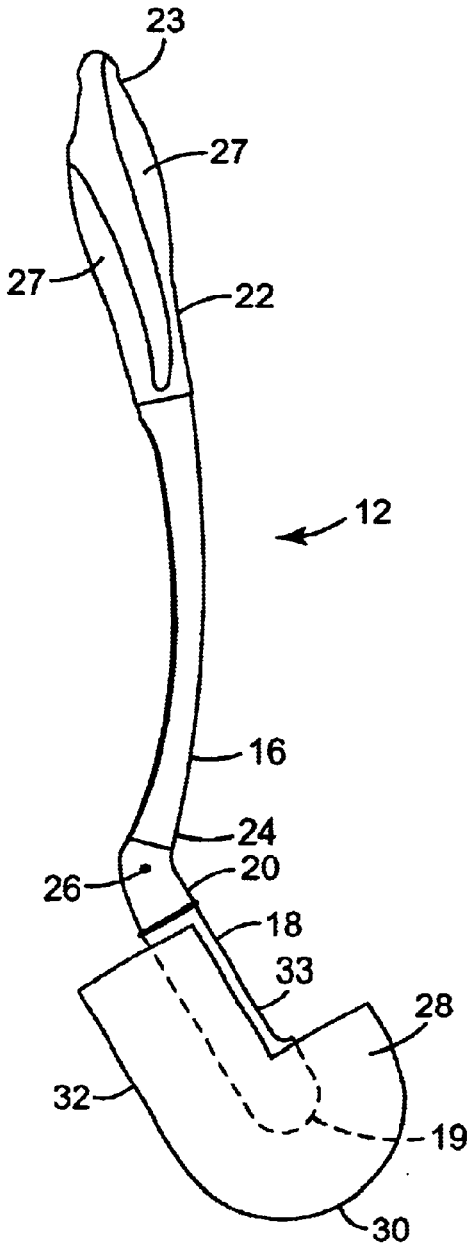
FIG. 3 is an enlarged side view of the brush included in the combination of FIG. 1.
Figure 4:
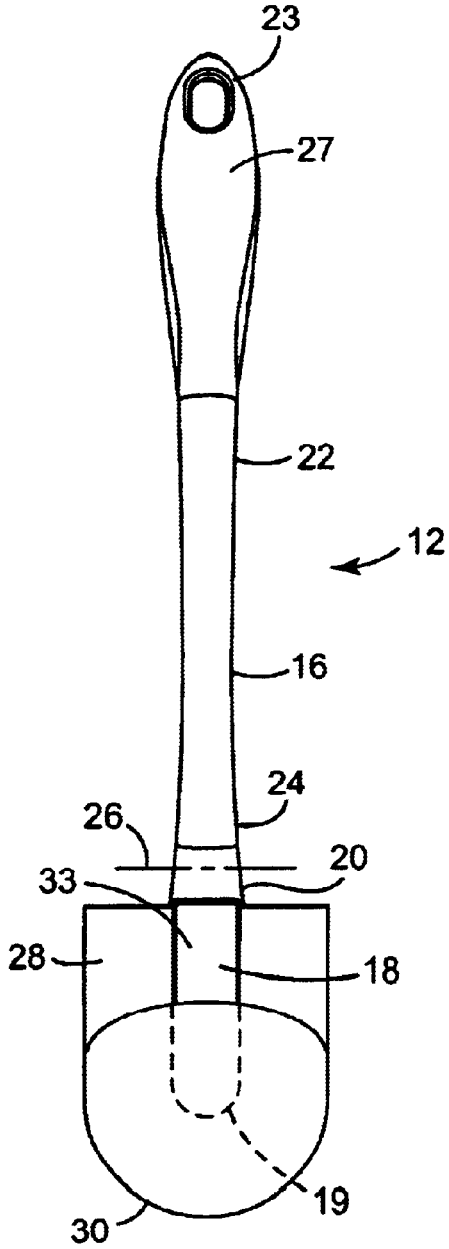
FIG. 4 is an enlarged top view of the brush included in the combination of FIG. 1.

Referring now to FIGS. 1 through 10 of the drawing, there is shown a combination 10 according to the present invention including a first embodiment of a cleaning implement or brush 12 and a caddy 14 according to the present invention.

Generally, the brush 12 (best seen in FIGS. 3 and 4) comprises a stiff elongate support member 16 of a polymeric material (e.g., polypropylene). The support member 16 includes a generally straight support end portion 18 having opposite first and second ends 19 and 20, and a handle end portion 22 having opposite first and second ends 23 and 24. The second ends 20 and 24 of the support and handle end portions 18 and 22 are fixed together (e.g., integrally molded together as illustrated) with the support end portion 18 and the handle end portion 22 disposed at an obtuse angle with respect to each other about a first axis 26 (e.g., as illustrated that obtuse angle is about 153 degrees between the centerline of the support end portion 18 and a straight line extending between the ends 23 and 24 of the handle end portion 22). A part of the handle end portion 22 adjacent its first end 23 is adapted for manual engagement and may, as illustrated, have adhered thereto a thin layer 27 of a non-slip material such as a colored thermoplastic rubber having a decorative outline. The brush 12 includes scrubbing members or bristles 28 (e.g., stiff fibers of polypropylene) having inner end parts supported on (e.g., imbedded in) the support end portion 18. Outer potions or ends of some of the bristles 28 at the first end 19 of the support end portion 18 define a convex arcuate end peripheral surface portion 30 (e.g., a convex semi-spherical end peripheral surface portion 30 as illustrated) extending about 180 degrees around the first end 19 of the support end portion 18. Outer portions or ends of other bristles 28 along the support end portion 18 further define a convex arcuate side peripheral surface portion 32 (e.g., a convex semi-cylindrical side peripheral surface portion 32 as illustrated) extending from the convex arcuate end peripheral surface portion 30 toward the second end 20 of the support portion 18 about 180 degrees around the side of the support end portion 18 opposite the obtuse angle at which the support end portion 18 and the handle end portion 22 are disposed about the axis 26. The support end portion 18 is free of bristles along a part 33 of the support end portion 18 opposite the convex arcuate side peripheral surface portion 32 defined by the bristles 28 and adjacent the second end 20 of the support end portion 18.

Figure 5:
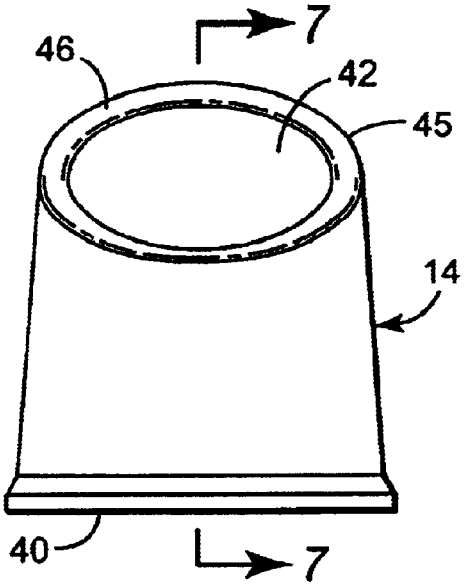
FIG. 5 is a front view of the caddy according to the present invention included in the combination of FIG. 1.
Figure 6:
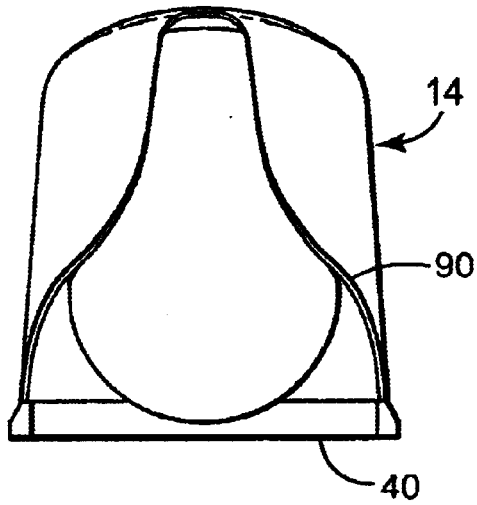
FIG. 6 is a rear view of the caddy included in the combination of FIG. 1.
Figure 7:
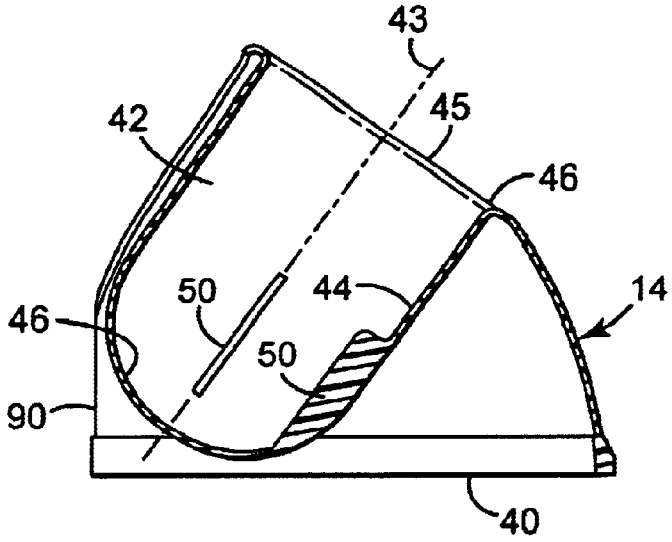
FIG. 7 is a fragmentary sectional view taken approximately along line 7—7 of FIG. 5.

The caddy 14 according to the present invention, best seen in FIGS. 5, 6, and 7, is a unitary molding of a polymeric material (e.g., polypropylene) comprising walls having a supported edge surface 40 in a plane adapted to be supported on a horizontal surface. The caddy 14 also has receiving surfaces defining a socket 42 in the caddy 14 adapted to receive and support the bristles 28 and the support end portion 18 of the brush 12. Those receiving surfaces include a concave arcuate side surface 44 adjacent the edge surface 40 (e.g., a concave semi-cylindrical side surface 44 as illustrated) adapted to conform to and support the convex arcuate side peripheral surface portion 32 defined by the outer ends of the bristles 28. That concave arcuate side surface 44 has a longitudinal axis (i.e., the longitudinal axis or centerline 43 of the socket 42) disposed at an acute angle (e.g., about 55 degrees as illustrated) with respect to the plane of the supported edge surface 40 and extending from an inlet end 45 of the socket 42 toward the plane of the supported edge surface 40. The receiving surfaces defining the socket 42 further including a concave arcuate end surface 46 (e.g., a concave semi-spherical end surface 46 as illustrated) defining the end of the socket 42 opposite its inlet end 45 adapted to conform to and support the convex arcuate peripheral surface portion 30 defined by the outer ends of the bristles 28.

Figure 8:
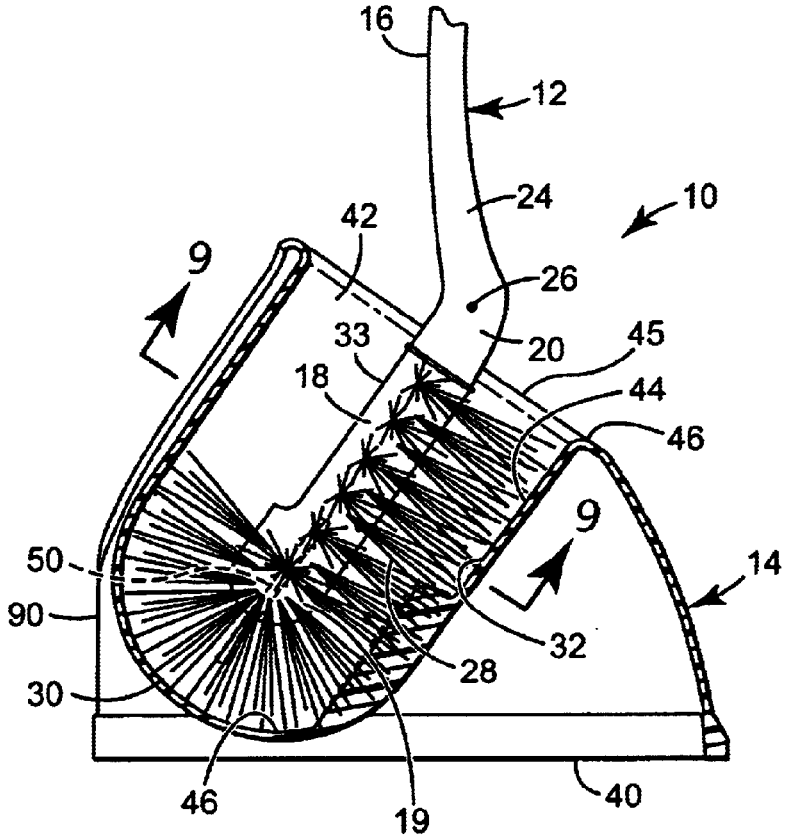
FIG. 8 is a fragmentary sectional view taken approximately along line 8—8 of FIG. 1.
Figure 9:
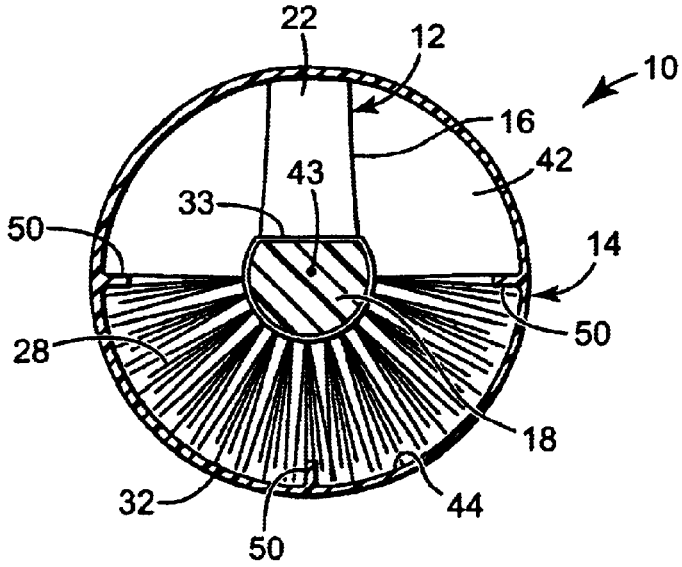
FIG. 9 is a fragmentary sectional view taken approximately along line 9—9 of FIG. 8.
Figure 10:
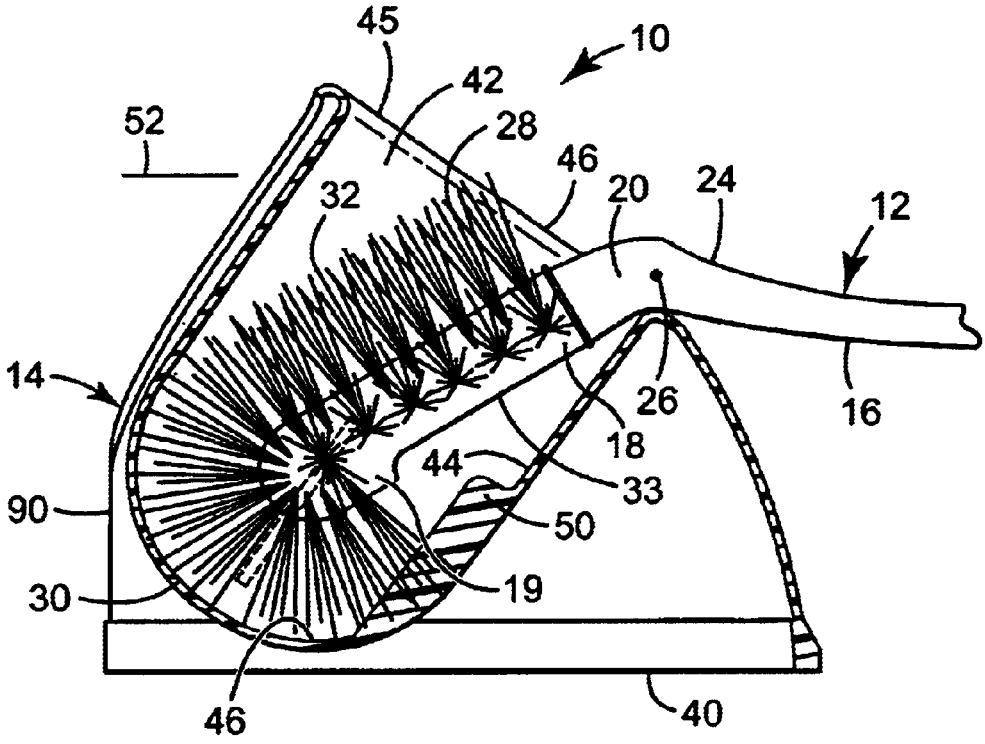
FIG. 10 is a fragmentary sectional view taken approximately along line 10—10 of FIG. 2.

The brush 12 can be received and stored in the socket 42 of the caddy 14 in a first or vertical storage position illustrated in FIGS. 1, 8, and 9 with the ends of the bristles 28 defining the convex arcuate end peripheral surface portion 30 of the brush 12 resting against the concave arcuate end surface 46 defining the inner end of the socket 42, with the ends of the bristles defining the convex arcuate side peripheral surface portion 32 of the brush supported against the concave arcuate side surface 32 so that the centerline of the socket 42 is aligned with the centerline of the support end portion 18, and with the handle portion 22 of the brush 12 outside of the socket 42 in the caddy 14 and projecting generally normally away from the supported edge surface 40 of the caddy 14 so that if the supported edge surface 40 of the caddy 14 is supported on a horizontal surface such as the floor of a bathroom, the handle end portion 22 will project generally vertically upwardly. Alternatively, the brush 12 can be received and stored in the socket 42 in a second or horizontal storage position illustrated in FIGS. 2 and 10 with the ends of the bristles 28 defining the convex arcuate end peripheral surface portion 30 of the brush supported against the concave arcuate end surface 46 defining the inner end of the socket 42 in the caddy 14, with the bristle free part 33 of the support end portion 18 opposite the convex arcuate side peripheral surface portion 32 supported against the caddy 14 at the inlet end 45 of the socket 42 so that the centerline of the support end portion 18 is at an angle of about 23 degrees with respect to the axis or centerline 43 of the socket 42, and with the handle end portion 22 outside of the socket 42 and projecting away from the caddy 14 generally parallel to the supported edge surface 40 of the caddy 14. In this horizontal storage position, the maximum height of the brush 12 above the supported edge surface 40 of the caddy 14 is significantly less than its maximum height in the vertical storage position (e.g., about 4.5 inches or 11.4 cm compared to about 16 inches or 40.6 cm) and less than the height of the caddy 14 (i.e., about 5.8 inches or 14.7 cm) so that the caddy 14 with the brush 12 in it has a height that facilitates storage of the caddy 14 containing the brush 12 in cabinets of the types typically found in bathrooms (e.g., a vanity).

When, as illustrated, the longitudinal central axis 43 of the socket 42 is disposed at an acute angle of about 55 degrees with respect to the plane of the supported edge surface 40, and the support end portion 18 and the handle end portion 22 of the brush are disposed at an obtuse angle with respect to each other about the first axis 26 of about 153 degrees measured between the centerline of the support end portion 18 and a straight line extending between the ends 23 and 24 of the handle end portion 22, in the vertical storage position described above the handle portion 22 of the brush 12 projects away from the supported edge surface 40 of the caddy 14 at an angle of about 82 degrees which is considered generally normal with respect to the supported edge surface 40, as would be considered angles of greater than about 70 degrees. In the horizontal storage position described above in which centerline of the support end portion 18 is at an angle of about 23 degrees with respect to the centerline or axis 43 of the socket 42 or about 32 degrees with respect to the supported edge surface 40, the handle portion 22 of the brush 12 projects at an angle of about away from the supported edge surface 40 of the caddy 14 at an angle of about 4 degrees which is considered generally parallel with respect to the supported edge surface 40, as would be considered angles of less than about 15 degrees.

The caddy 14 includes means for restricting rotation of the support end portion 18 about the axis of the socket 42 when the bristles 28 and the support end portion 18 are in the socket 42 in the vertical storage position described above. That means for restricting rotation as illustrated comprises spaced thin locating members or plates 50 having parallel side surfaces parallel to the axis of the socket 42 that project into the socket 42. The locating plates 50 are received between end portions of the bristles 28 when the bristles 28 and the support end portion 18 are within the socket 42 in the vertical storage position at which, if the supported edge surface 40 of the caddy 14 is supported on a horizontal surface such as the floor of a bathroom, the handle end portion 22 will project generally vertically upwardly. Engagement of end portions of the bristles 28 against the side surfaces of the locating plates 50 will then restrict rotation of the support end portion 18 about the axis of the socket 42 under the influence of the weight of the handle end portion 22; which rotation, if it occurred, could cause the handle end portion 22 to move to a lower position out of its upwardly projecting position. The locating members could have shapes other than that illustrated, such as triangular or semi oval cross sections, and should have shapes that easily separate the bristles and allow movement of the separated bristles along opposite sides of the locating members 50.

As illustrated, the convex end peripheral surface portion 30 defined by the outer ends of the bristles 28 and the concave end surface 46 of the caddy 14 against which that peripheral surface 30 is supported when the brush is in the caddy 14 are both semi-spherical; and the convex side peripheral surface portion 32 defined by the outer ends of the bristles 28 and the concave side surface 44 of the caddy 14 against which that side peripheral surface 32 is supported when the brush is in the caddy 14 in the vertical storage position described above are both semi-cylindrical. Those surfaces 30, 46, 32, and 44 have been described as arcuate to include the possibility that those surfaces 30, 46, 32, and 44 could be other than truly semi-spherical or semi-cylindrical, but could have other regular or irregular curved shapes.

When the surfaces and surface portions 30, 46, 32, and 44 are truly semi-spherical or semi-cylindrical as illustrated, the brush 12 can be received and stored in the socket 42 of the caddy 14 in many optional positions in addition to the first and horizontal storage positions described above with the handle end portion 22 extending over any portion of the inlet end 45 of the socket 42. With the handle end portion 22 projecting over portions of the inlet end 45 of the socket within about 45 degrees around the inlet end 45 of the socket in either direction from its position in the vertical storage position (FIGS. 1, 8, and 9), the ends of the bristles 28 defining the convex arcuate end peripheral surface portion 30 of the brush 12 will rest against the concave arcuate end surface 46 defining the inner end of the socket 42, and the ends of the bristles defining the convex arcuate side peripheral surface portion 32 of the brush 12 will be at least partially supported against the concave arcuate side surface 32 as in the vertical storage position. With the handle end portion 22 projecting over portions of the inlet end 45 of the socket within about 135 degrees in either direction around the inlet end 45 of the socket from its position in the horizontal storage position (FIGS. 2 and 10) the ends of the bristles 28 defining the convex arcuate end peripheral surface portion 30 of the brush will be supported against the concave arcuate end surface 46 defining the inner end of the socket 42 in the caddy 14, and the bristle free part 33 of the support end portion 18 opposite the convex arcuate side peripheral surface 32 will be supported against the caddy 14 at the inlet end 45 of the socket 42 as in the horizontal storage position. The handle end portion 22 will be outside of the socket 42 projecting away from the caddy 14 in various directions in those optional positions, one of which directions, under certain circumstances, may provide an advantage for locating or storing the caddy 14 and brush 12. In any of those optional positions engagement of end portions of the bristles 28 against the side surfaces of the locating members or plates 50 will restrict rotation of the support end portion 18 about the axis of the socket 42 under the influence of the weight of the handle end portion 22.

Figure 11:
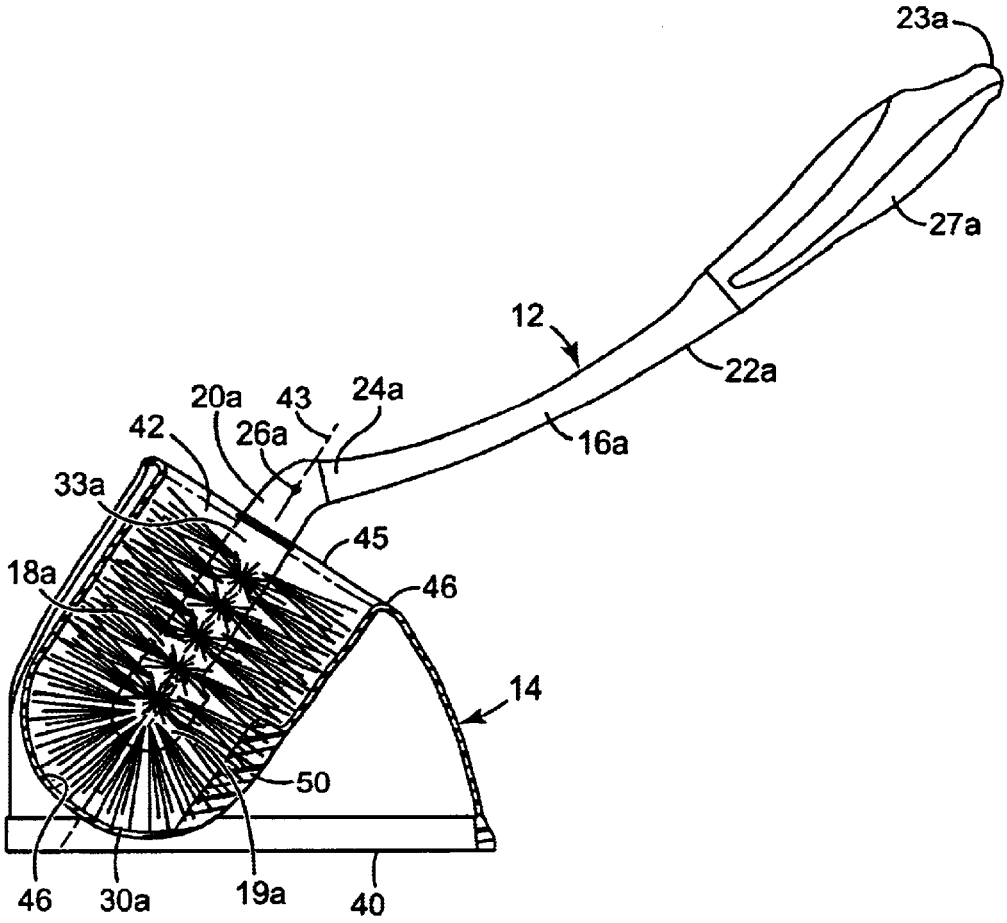
FIG. 11 is a sectional side view of the brush caddy according to the present invention as shown in FIGS. 1–10 in combination with a second embodiment of a cleaning implement or brush in which the brush is positioned in the caddy in a horizontal storage position with a handle portion of the brush outside of the caddy and projecting generally horizontally away from the caddy.

As is illustrated in FIG. 11, the caddy 14 could be used to receive a second embodiment of a cleaning implement or brush 12*a* (parts of the brush 12*a* that correspond to parts of the brush 12 have been given the same reference numeral to which has been added the suffix "a") having about the same configuration as the brush 12 except that the support end portion 18*a* has bristles supported on or embedded in the part 33*a* of the support end portion 18*a* opposite the convex arcuate side peripheral surface portion 32*a* defined by the bristles 28*a* and adjacent the second end 20*a* of the support end portion 18*a*. A vertical storage position for the brush 12*a* (not illustrated) will be essentially the same as the vertical storage position for the brush 12 illustrated in FIGS. 1, 8, and 9 at which the ends of the bristles 28*a* defining the convex arcuate end peripheral surface portion 30*a* of the brush 12*a* rest against the concave arcuate end surface 46 defining the inner end of the socket 42, with the ends of the bristles 28*a* defining the convex arcuate side peripheral surface portion 32*a* of the brush 12*a* supported against the concave arcuate side surface 32 so that the centerline or axis 43 of the socket 42 is about aligned with the centerline of the support end portion 18*a*, and the handle portion 22*a* of the brush 12*a* is outside of the socket 42*a* in the caddy 14 and projects generally normally away from the supported edge surface 40 of the caddy 14 so that if the supported edge surface 40 of the caddy 14 is supported on a horizontal surface such as the floor of a bathroom, the handle end portion 22*a* will project generally vertically upwardly. Alternatively, the brush 12*a* can be received and stored in the socket 42 in a horizontal storage position illustrated in FIG. 11 with the ends of the bristles 28*a* defining the convex arcuate end peripheral surface portion 30*a* of the brush 12*a* supported against the concave arcuate end surface 46 defining the inner end of the socket 42 in the caddy 14, and with the bristles along the part 33*a* of the support end portion 18*a* opposite the convex arcuate side peripheral surface portion 32*a* supported against the concave arcuate side surface 44 adjacent the edge surface 40 so that the centerline of the support end portion 18*a* is about aligned with the centerline of the socket 42*a*, and the handle end portion 22*a* is outside of the socket 42*a* and projecting away from the caddy 14*a* at an angle of about 23 degrees with respect to the supported edge surface 40 of the caddy 14. In this horizontal storage position for the brush 12*a*, the maximum height of the brush 12*a* above the supported edge surface 40 of the caddy 14 is still significantly less than its maximum height in the vertical storage position (e.g., about 10 inches or 25.4 cm compared to about 16 inches or 40.6 cm) and, while more than the height of the caddy 14 (i.e., about 5.8 inches or 14.7 cm), still may be sufficiently low that it facilitates storage of the caddy 14 containing the brush 12*a* in cabinets of the types typically found in bathrooms (e.g., a vanity).

In the horizontal storage position described above in which centerline of the support end portion 18*a* is along the centerline of the socket 42 or at about 55 degrees with respect to the supported edge surface portion 40, the handle portion 22 of the brush 12 projects away from the supported edge surface 40 of the caddy 14 at an angle of about 28 degrees which for such a handle portion 22, is considered roughly parallel with respect to the supported edge surface 40 as would be considered angles of less than about 30 degrees.

Figure 12:
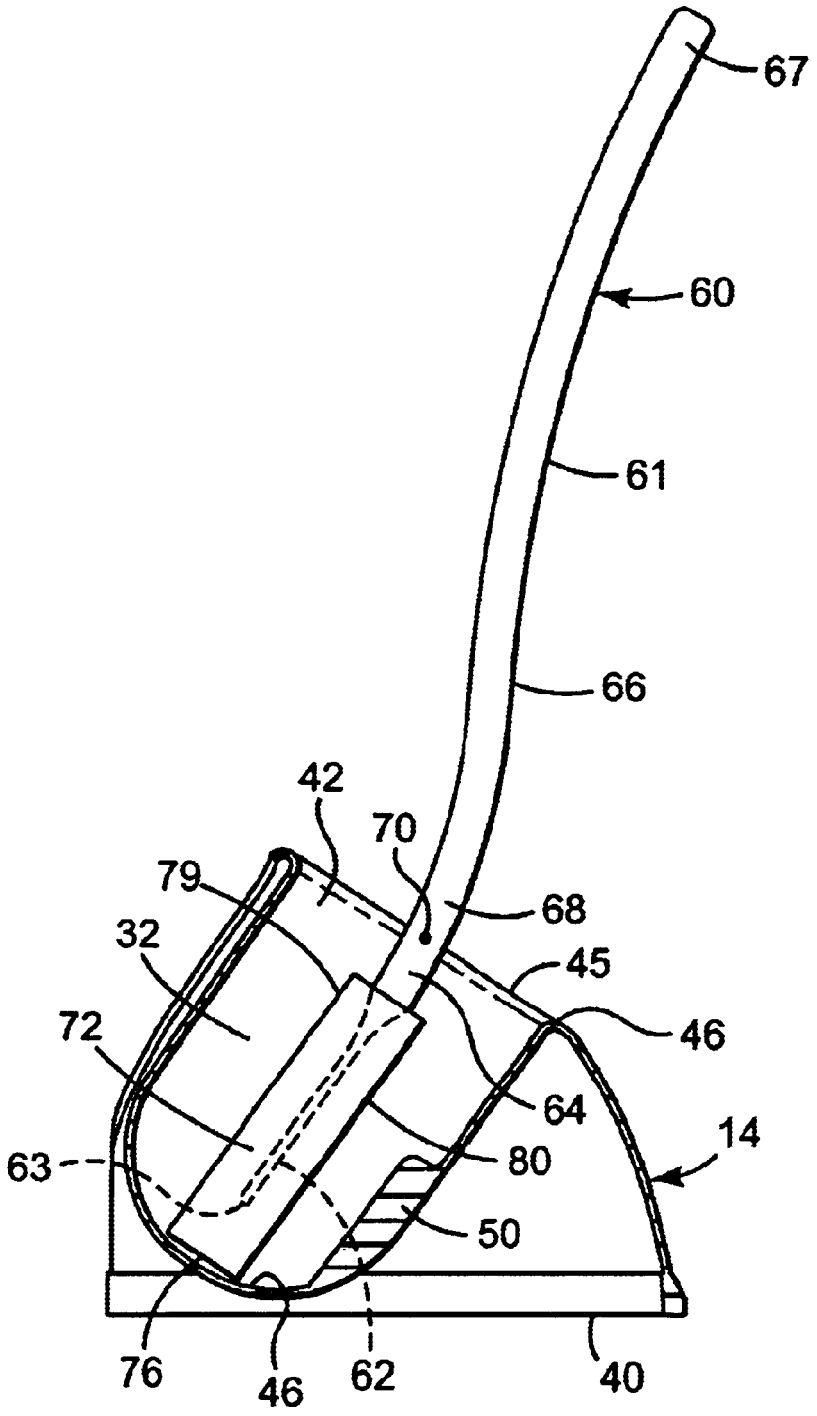
FIG. 12 is a sectional side view of the caddy according to the present invention as shown in FIGS. 1–10 in combination with a third embodiment of a cleaning implement in which the cleaning implement is positioned in the caddy in a vertical storage position with a handle portion of the cleaning implement outside of the caddy and projecting generally vertically upwardly away from the caddy.
Figure 13:
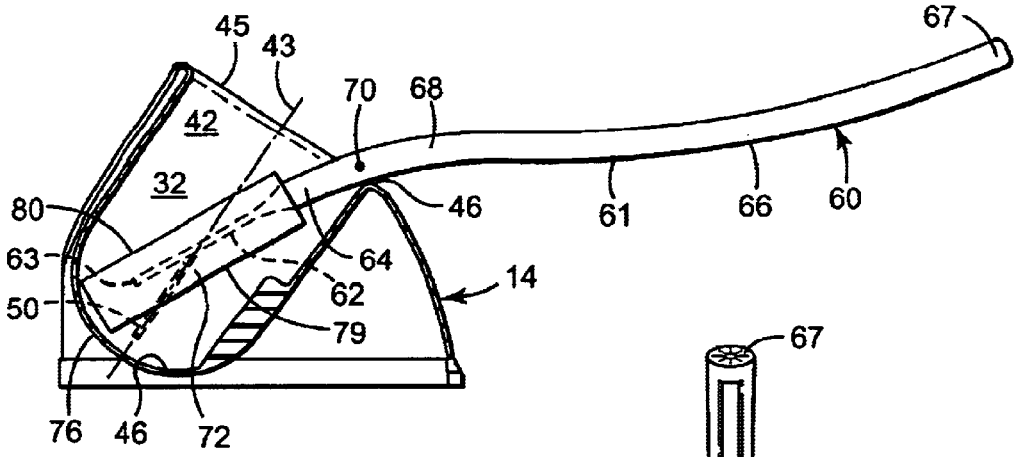
FIG. 13 is a sectional side view of the caddy according to the present invention in combination with the third embodiment of the cleaning implement shown in FIG. 12 in which the cleaning implement is positioned in the caddy in a horizontal storage position with a handle portion of the cleaning implement outside of the caddy and projecting generally horizontally away from the caddy.
Figure 14:
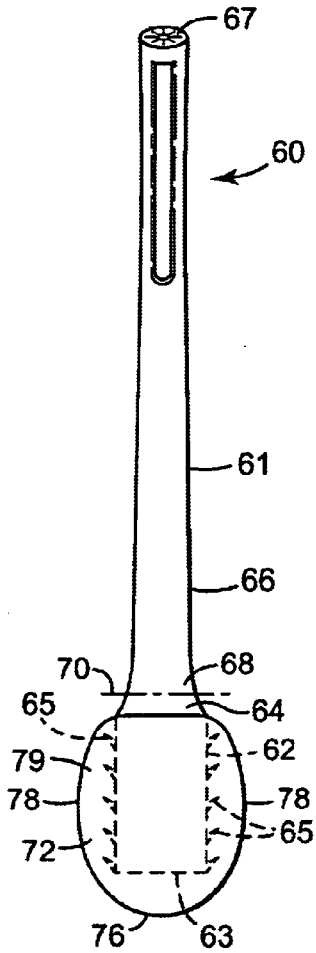
FIG. 14 is a top view of the cleaning implement shown in FIGS. 12 and 13.

As is illustrated in FIGS. 12 and 13, the caddy 14 could be used to receive a third embodiment of a cleaning implement 60 (see also FIG. 14) such as the cleaning implement 60 commercially designated as a "SCOTCH BRITE" (trade mark) One Scrub, that has been commercially available from 3M Company, St. Paul, Minn., for many years. That cleaning implement 60 comprises an elongate support member 61 including a generally straight support end portion 62 having opposite first and second ends 63 and 64, and a handle end portion 66 having opposite first and second ends 67 and 68. The second ends 64 and 68 of the support and handle end portions 61 and 66 are fixed together (e.g., by being integrally molded) with the support end portion 62 and the handle end portion 66 disposed at an obtuse angle with respect to each other about a first axis 70 (e.g., that obtuse angle is about 156 degrees between the centerline of the support end portion 18 and a straight line extending between the ends 67 and 68 of the handle end portion 66). A part of the handle end portion 66 adjacent its first end 67 is adapted for manual engagement. The cleaning implement includes a pad 72 of scrubbing members in the form of randomly disposed spaced polymeric fibers (e.g., of polyester) bonded together with a resin (e.g., polyurethane) at points where the fibers contact each other and coated with mineral (e.g., the "SCOTCH BRITE" (trade mark) scrubbing material commercially available from 3M Company, St. Paul, Minn.), which fibers have inner parts supported on the support end portion 61 which has barbs 65 engaged with the fibers to hold the pad 72 on the support end portion 61. The pad 72 has an outer surface defined by portions of the scrubbing members opposite those inner parts that includes a convex arcuate end peripheral surface portion 76 extending about 180 degrees around the first end 63 of the support end portion 61, and opposite convex arcuate side peripheral surface portions 78 extending from that convex arcuate end peripheral surface portion 76 toward the second end 64 of the support end portion 62, which end and side peripheral surface portions 76 and 78 extend between opposite planar parallel top and bottom surface portions 79 and 80 of the pad 72.

At a vertical storage position for the cleaning implement 60 illustrated in FIG. 12, the end peripheral surface portion 76 defined by the scrubbing members will rest against the concave arcuate end surface 46 defining the inner end of the socket 42, and the convex arcuate side peripheral surface portions 78 will engage the concave arcuate side surface 32 and the locating members 50 so that the centerline of the support end portion 18*a* is about aligned with the centerline 43 of the socket 42, and the handle end portion 66 of the cleaning implement 60 is outside of the socket 42 in the caddy 14 and projects generally normally away from the supported edge surface 40 of the caddy 14 so that if the supported edge surface 40 of the caddy 14 is supported on a horizontal surface such as the floor of a bathroom, the handle end portion 22*a* will project generally vertically upwardly. Alternatively, the cleaning implement 60 can be received and stored in the socket 42 in a horizontal storage position illustrated in FIG. 13 with the convex arcuate end peripheral surface portion 76 defined by the scrubbing members supported against the concave arcuate end surface 46 defining the inner end of the socket 42 in the caddy 14, and with the support member 61 supported against the caddy 14 at the inlet end 45 of the socket 42 so that the centerline of the support end portion 62 is at an angle of about 23 degrees with respect to the centerline or axis 43 of the socket 42, and with the handle end portion 66 outside of the socket 42 and projecting away from the caddy 14 generally parallel to the supported edge surface 40 of the caddy 14. In this horizontal storage position, the maximum height of the cleaning implement 60 above the supported edge surface 40 of the caddy 14 is significantly less than its maximum height in the vertical storage position (e.g., about 6 inches or 15 cm compared to about 16 inches or 40.6 cm) and about the height of the caddy 14 (i.e., about 5.8 inches or 14.7 cm) so that the caddy 14 with the cleaning implement 60 in it has a height that facilitates storage of the caddy containing the brush in cabinets of the types typically found in bathrooms (e.g., a vanity).

The caddy 14 according to the present invention has now been described with reference to one embodiment and in combination with several cleaning implements 12, 12*a* and 60 together with several possible modifications thereof. It will be apparent to those skilled in the art that many changes can be made in the embodiments and combinations described above without departing from the scope of the present invention. For example, the convex arcuate end peripheral surface portions 30 defined by the outer ends of the bristles 28 of the brush 12 and the arcuate concave end surface 46 of the caddy 14 against which that peripheral surface 30 is supported when the brush 12 is in the caddy 14 instead of being truly semi-spherical could have a central semi-cylindrical portion around an axis parallel to the axis 26 which could limit storage positions of the brush within the caddy 14 to the first and horizontal storage positions described above and could provide the means for restricting rotation of the support end portion 18 about the axis 43 of the socket 42 when the bristles 28 and the support end portion 18 are in the socket 42 in the vertical storage position. Also, to further limit the height between the supported surface 40 and the highest point of the caddy 14 or the brush 12 in the horizontal storage position, an upper part of the caddy 14 above about a horizontal line 52 shown in FIG. 10 could be removed as the portion of the socket 42 defined by surfaces above that line 52 make no contact with the bristles 28 of the brush 12 in either the first or second storage portions. Also, the caddy 14 could be provided with a wall along its side 90 having a planer surface disposed at a right angle with respect to the supporting edge surface 40, which wall could have an opening for receiving a hook or the like by which the caddy 14 could be hung on a wall. Additionally, a cover could be provided over the inlet end 45 of the socket 42, which cover could be slotted to facilitate positioning the cleaning implements 12, 12*a* or 60 in either their vertical or horizontal storage positions. Thus, the scope of the present invention should not be limited to the structures described in this application, but only by the structures described by the language of the claims and the equivalents thereof.

What is claimed is:

1. A caddy for storing a cleaning implement comprising an elongate support member, said support member including a generally straight support and portion having opposite first and second ends, and a handle end portion having opposite first and second ends, the second ends of said support and handle end portions being fixed together with said support end portion and said handle end portion disposed at an obtuse angle with respect to each other about a first axis, a part of the handle end portion adjacent the first end of said handle end portion being adapted for manual engagement, and the cleaning implement including scrubbing members having inner end parts supported on said support end portion with outer portions of some of said scrubbing members opposite said inner end parts defining a convex arcuate end peripheral surface portion extending about 180 degrees around the first end of said support end portion, and outer portions of some of said scrubbing members defining a convex arcuate side peripheral surface portion extending from said convex arcuate end peripheral surface portion toward the second end of said support end portion, said caddy comprising walls having a supported surface adapted to be supported on a horizontal surface, and having receiving surfaces defining a socket adapted to receive and support the scrubbing members of said cleaning implement, said receiving surfaces including a concave side surface adapted to support the convex side peripheral surface portion defined by said scrubbing members, said concave arcuate side surface having an axis disposed at about an acute angle with respect to said supported surface and extending from an inlet end of said socket toward said support surface, said receiving surfaces further including a concave arcuate end surface at the end of the socket opposite said inlet end adapted to support the convex arcuate end peripheral surface portion defined by said scrubbing members, the cleaning implement being adapted to either (1) be received in said socket in a vertical storage position with the outer ends of the scrubbing members defining the convex arcuate end peripheral surface portion resting against said concave arcuate end surface, with the outer portions of the scrubbing members defining the convex arcuate side peripheral surface portion resting against the concave arcuate side surface, and with said handle portion outside of said socket and projecting generally normally away from said supported surface of the caddy; or (2) received in said socket in a horizontal storage position with the convex end peripheral surface portion defined by the outer portions of the scrubbing members resting against the concave arcuate end surface, with said part of the support portion resting against the caddy at the inlet end of the socket, and with said handle portion outside of said socket and projecting away from the caddy generally parallel to said supported surface.

2. A caddy for storing a cleaning implement according the claim 1 wherein said concave arcuate side surface included in said receiving surface is semi-cylindrical.

3. A caddy for storing a cleaning implement according the claim 1 wherein said concave arcuate end surface included in said receiving surface is semi-spherical.

4. A caddy for storing a cleaning implement according the claim 1 wherein said caddy further includes means for restricting rotation of said support end portion in said socket when said scrubbing members and said support end portion are in said socket in said vertical storage position.

5. A caddy for storing a cleaning implement according to claim 4 wherein said means for restricting rotation of said support end portion in said socket comprises spaced locating members having parallel side surfaces projecting into said socket, said locating members being received between portions of the scrubbing members when the scrubbing members and support end portion are in said socket in said vertical storage position.

6. In combination, a brush comprising an elongate support member, said support member including a generally straight support end portion having opposite first and second ends, and a handle end portion having opposite first and second ends, the second ends of said support and handle end portions being fixed together with said support end portion and said handle end portion disposed at an obtuse angle with respect to each other about a first axis, a part of the handle end portion adjacent the first end of said handle end portion being adapted for manual engagement, and the cleaning brush including bristles having inner end parts supported on said support end portion with outer ends of some of said bristles opposite said inner end parts defining a convex arcuate end peripheral surface portion extending about 180 degrees around the first end of said support end portion, and outer ends of some of said bristles defining a convex arcuate side peripheral surface portion extending from said convex arcuate end peripheral surface portion toward the second end of said support end portion on the side of said support end portion opposite said obtuse angle, said support end portion being free of bristles along a part of the support end portion opposite said convex arcuate side periphery portion and adjacent said second end of said support end portion; and a caddy comprising walls having a supported surface adapted to be supported on a horizontal surface, and having receiving surfaces defining a socket adapted to receive and support the bristles of said brush, said receiving surfaces including a concave arcuate side surface adapted to support the convex side peripheral surface portion defined by said bristles, said concave arcuate side surface having an axis disposed at about an acute angle with respect to said supported surface and extending from an inlet end of said socket toward said supported surface, said receiving surfaces further including a concave arcuate end surface at the end of the socket opposite said inlet end adapted to support the convex arcuate end peripheral surface portion defined by said bristles, said brush being received in said socket either (1) in a vertical storage position with the outer ends of the bristles defining the convex arcuate end peripheral surface portion resting against said concave arcuate end surface, with the outer ends of the bristles defining the convex arcuate side peripheral surface portion resting against the concave arcuate side surface, and with said handle portion outside of said socket and projecting generally normally away from said supported surface of the caddy; or (2) in a horizontal storage position with the convex end peripheral surface portion defined by the outer ends of the bristles resting against the concave arcuate end surface, with said part of the support portion opposite said convex side peripheral surface portion that is free of bristles resting against the caddy at the inlet end of the socket, and with said handle portion outside of said socket and projecting away from the caddy generally parallel to said supported surface.

7. A combination according to claim 6 wherein said convex arcuate side peripheral surface portion defined by said bristles and concave arcuate side surface including in said receiving surface are both semi-cylindrical.

8. A combination according to claim 6 wherein said convex arcuate end peripheral surface portion defined by said bristles and said concave arcuate end surface included in said receiving surface are both semi-spherical.

9. A combination according to claim 6 wherein said caddy further includes means for restricting rotation of said support end portion in said socket when said bristles and said support end portion are in said socket in said vertical storage position.

10. A combination according to claim 9 wherein said means for restricting rotation of said support end portion in said socket comprises spaced locating members having parallel side surfaces projecting into said socket, said locating plates being received between end portions of the bristles when the bristles and support end portion are in said socket in said vertical storage position.

11. A caddy for storing a cleaning implement comprising an elongate support member, said support member including a generally straight support end portion having opposite first and second ends, and a handle end portion having opposite first and second ends, the second ends of said support and handle end portions being fixed together with said support end portion and said handle end portion disposed at an obtuse angle with respect to each other about a first axis, a part of the handle end portion adjacent the first end of said handle end portion being adapted for manual engagement, and the cleaning implement including scrubbing members having inner parts supported on said support end portion with an outer surface defined by said scrubbing members opposite said inner parts defining a convex arcuate end peripheral surface portion extending about 180 degrees around the first end of said support end portion, and outer surfaces of some of said scrubbing members defining a convex arcuate side peripheral surface portion extending from said convex arcuate end peripheral surface toward the second end of said support end portion, said caddy comprising walls having a supported surface adapted to be supported on a horizontal surface, and having receiving surfaces defining a socket adapted to receive and support the scrubbing members of said cleaning implement, said receiving surfaces including a concave arcuate side surface adapted to support the convex side peripheral surface defined by said scrubbing members, said concave arcuate side surface having an axis disposed at an acute angle with respect to said supported surface and extending from an inlet end of said socket toward said supported surface, said receiving surfaces further including a concave arcuate end surface at the end of the socket opposite said inlet end adapted to support the convex arcuate end peripheral surface portion defined by said scrubbing members, the cleaning implement being adapted to either (1) be received in said socket in a vertical storage position with the peripheral surface of the scrubbing members defining the convex arcuate end peripheral surface portion resting against said concave arcuate end surface, with the peripheral surface of the scrubbing members defining the convex arcuate side peripheral surface portion resting against the concave arcuate side surface, and with said handle portion outside of said socket and projecting generally normally away from said supported surface of the caddy; or (2) received in said socket in a horizontal storage position with the convex end peripheral surface portion defined by the scrubbing members resting against the concave arcuate end surface, with the convex arcuate side peripheral surface portion defined by the scrubbing members resting against the concave arcuate side surface, and with said handle portion outside of said socket and projecting away from the caddy roughly parallel to said supported surface.

12. A caddy for storing a cleaning implement according to claim 11 wherein said concave arcuate side surface included in said receiving surfaces is semi-cylindrical, and said concave arcuate end surface included in said receiving surfaces is semi-spherical.

13. A caddy for storing a cleaning implement according to claim 11 wherein said caddy further includes means for restricting rotation of said support end portion in said socket when said scrubbing members and said support end portion are in said socket in said vertical storage position.

14. A caddy for storing a cleaning implement according to claim 11 wherein said scrubbing members comprise randomly disposed spaced polymeric fibers bonded together at points where the fibers contact each other.

15. A caddy for storing a brush according to claim 11 wherein said scrubbing members comprise bristles supported on and projecting from said support end portion.

16. In combination:

a cleaning implement comprising an elongate support member, said support member including a generally straight support end portion having opposite first and second ends, and a handle end portion having opposite first and second ends, the second ends of said support and handle end portions being fixed together with said support end portion and said handle end portion disposed at an obtuse angle with respect to each other about a first axis, a part of the handle end portion adjacent the first end of said handle end portion being adapted for manual engagement, and the cleaning implement including scrubbing members having inner parts supported on said support end portion with an outer surface defined by said scrubbing members opposite said inner parts defining a convex arcuate end peripheral surface portion extending about 180 degrees around the first end of said support end portion, and outer surfaces of some of said scrubbing members defining a convex arcuate side peripheral surface portion extending from said convex arcuate end peripheral surface portion toward the second end of said support end portion and a caddy comprising walls having a supported surface adapted to be supported on a horizontal surface, and having receiving surfaces defining a socket adapted to receive and support the scrubbing members of said cleaning implement, said receiving surfaces including a concave arcuate side surface adapted to support the convex side peripheral surface portion defined by said scrubbing members, said concave arcuate side surface portion having an axis disposed at an acute angle with respect to said supported surface and extending from an inlet end of said socket toward said supported surface, said receiving surfaces further including a concave arcuate end surface at the end of the socket opposite said inlet end adapted to support the convex arcuate end peripheral surface portion defined by said scrubbing members, the cleaning implement being received in said socket either (1) in a vertical storage position with the peripheral surface portion of the scrubbing members defining the convex arcuate end peripheral surface resting against said concave arcuate end surface, with the peripheral surface of the scrubbing members defining the convex arcuate side peripheral surface portion resting against the concave side surface, and with said handle portion outside of said socket and projecting generally normally away from said supported surface of the caddy; or (2) in a horizontal storage position with the convex end peripheral surface portion defined by peripheral surface of the scrubbing members resting against the concave arcuate end surface, with the peripheral surface of the scrubbing members defining the convex arcuate side peripheral surface portion resting against the concave arcuate side surface, and with said handle portion outside of said socket and projecting away from the caddy roughty parallel to said support surface.

17. A combination according the claim 16 wherein said concave arcuate side surface including in said receiving surfaces is semi-cylindrical, and said concave arcuate end surface including in said receiving surfaces is semi-spherical.

18. A combination according to claim 16 wherein said caddy further includes means for restricting rotation of said support end portion in said socket when said scrubbing members and said support end portion are in said socket in said vertical storage position.

19. A combination according to claim 16 wherein said scrubbing members comprise randomly disposed spaced polymeric fibers bonded together at points where the fibers contact each other.

20. A combination according to claim 16 wherein said scrubbing members comprise bristles supported on and projecting from said support end portion.

* * * * *

UNITED STATES PATENT AND TRADEMARK OFFICE

CERTIFICATE OF CORRECTION

PATENT NO. : 6,902,056 B2
DATED : June 7, 2005
INVENTOR(S) : Dotterman, Perry S.

It is certified that error appears in the above-identified patent and that said Letters Patent is hereby corrected as shown below:

Column 9,
Line 27, delete “and” and insert -- end --.
Line 50, after “concave” insert -- arcuate --.
Line 55, delete “support” and insert -- supported --.

Column 10,
Lines 12, 15 and 18, delete “the” and insert -- to --.

Column 11,
Line 26, after “and” insert -- said --.
Line 26, delete “including” and insert -- included --.

Column 13,
Line 5, after “portion” insert -- ; --.
Line 29, after “concave” insert -- arcuate --.

Column 14,
Line 11, delete “roughty” and insert -- roughly --.
Line 12, delete “support” and insert -- supported --.
Lines 14 and 16, delete “including” and insert -- included --.

Signed and Sealed this

Thirtieth Day of August, 2005

JON W. DUDAS
*Director of the United States Patent and Trademark Office*